United States Patent [19]

Lawson

[11] 4,405,261

[45] Sep. 20, 1983

[54] SUBSEA TEMPLATE LEVELLING SYSTEM AND METHOD

[75] Inventor: John E. Lawson, London, England

[73] Assignee: Armco Inc., Middletown, Ohio

[21] Appl. No.: 256,507

[22] Filed: Apr. 22, 1981

[30] Foreign Application Priority Data

Apr. 14, 1981 [GB] United Kingdom ..... 8111788

[51] Int. Cl.[3] ..... E02D 5/00; E02D 5/74; E21B 33/047

[52] U.S. Cl. ..... 405/227; 405/224; 166/366

[58] Field of Search ..... 405/195–203, 405/224, 225, 227, 228; 166/341, 343, 360, 366; 175/7; 52/122.1, 126.1

[56] References Cited

U.S. PATENT DOCUMENTS

| | | | |
|---|---|---|---|
| 2,839,164 | 6/1958 | Roussel | 188/67 |
| 2,873,580 | 2/1959 | Suderow | 405/199 |
| 2,944,403 | 7/1960 | Smith | 405/199 |
| 3,310,108 | 3/1967 | Yancey | 166/351 |
| 3,504,740 | 7/1970 | Manning | 166/362 |
| 3,570,032 | 3/1971 | Allen | 405/199 |
| 3,672,177 | 6/1972 | Manning | 405/227 |
| 4,069,683 | 1/1978 | Jansz | 405/228 X |
| 4,127,991 | 12/1978 | Regan | 405/202 |
| 4,192,383 | 3/1980 | Kirkland et al. | 405/225 X |
| 4,212,562 | 7/1980 | Stone et al. | 405/195 |

OTHER PUBLICATIONS

1978–1979 *Composite Catalog,* p. 6880, Vetco.
1978–1979 *Composite Catalog,* p. 4417, Lynes.
*Offshore,* Apr. 1981, p. 192 et sequa, "Jacks Perform Balancing Act," R. M. Brem, D. E. Sculley.

*Primary Examiner*—David H. Corbin
*Assistant Examiner*—Nancy J. Pistel
*Attorney, Agent, or Firm*—Roylance, Abrams, Berdo & Farley

[57] ABSTRACT

A template levelling system and method for levelling a drilling or production template adjacent the bottom of a body of water on a plurality of suspension joints implanted in the floor of the body of water. The template has a plurality of passageways therein receiving the suspension joints which extend upwardly above the template. The template carries a pair of pivotable guideposts on opposite sides of each passageway. The levelling system includes a jacking assembly lowered by a handling string and including a hydraulic jack with an inner member slidably received in an outer member, a tension beam pivotally coupled to the inner member, a pair of tension joints pivotally and releasably coupled to the tension beam and engageable with the template guideposts, and a support beam receiving the outer member therein and releasably coupled to the tension joints via a pair of hydraulic slips assemblies.

22 Claims, 14 Drawing Figures

113
7
24
26
25
31
8
34
115
35
112
32
8
103
105
18
28
19
29
30
186
183
16
179
188
187
165
165
179a
181
182
181a
7
184
14
10
63
20
40
21
64
61
65
62
66
228
12

25
113
26
24
31
34
115
35
112
32
105
103
28
29
19
18
30
184
16
187
188
165
165
10
20
40
63
21
64
65
66
14
12

SUBSEA TEMPLATE LEVELLING SYSTEM AND METHOD

FIELD OF THE INVENTION

The invention relates to a system and method for installing and levelling a production or drilling template adjacent the floor of a body of water. The system includes a hydraulic jacking assembly lowered to the template, which has been previously landed on the floor of the body of water. A plurality of suspension joints are received in passageways in the template and are implanted in the floor, the jacking assembly being coupled to the suspension joints and the template during the levelling operation. After levelling, the jacking assembly is retrieved to the surface of the body of water.

BACKGROUND OF THE INVENTION

In recent years, the search for oil and gas has concentrated on formations below the surface of the oceans, seas and lakes of the world. During such exploration and the subsequent production of the oil and gas from the formation lying below the floor of the body of water, it is advantageous to drill a plurality of well holes close together and in a known orientation. As a result, large templates are used for this guidance purpose, usually consisting of a substantially planar array of tubes coupled together in a lattice and having a certain number of slots formed therein for receiving drill pipe or pipe for conducting the oil and the gas upwardly from the floor of the body of water after the production well is established.

The use of such templates, however, includes many difficulties. For example, the floor of a body of water, such as the seabed, is usually inclined and irregular, therefore requiring some type of levelling device for the template. In addition, such a template is usually maintained on the seabed for a long period of time and therefore is very difficult to maintain or repair. Many systems for installing templates require the costly and dangerous use of a diver, require extensive template mounted equipment and specially trained operators and require modified drilling technology or operations.

Examples of prior systems directed to levelling such templates are disclosed U.S. Pat. Nos. 3,310,108 to Yancey; 3,504,740 to Manning; 4,127,991 to Regan; and 4,212,562 to Stone et al. Additional prior devices that disclose levelling of platforms of various types are included in U.S. Pat. Nos. 2,839,164 to Roussel; 2,873,580 to Suderow; 2,944,403 to Smith; and 3,750,032 to Allen.

SUMMARY OF THE INVENTION

Accordingly, a primary object of the invention is to provide a system and method for installing and levelling a production or drilling template adjacent the floor of a body of water where the floor is inclined or of uneven contour.

Another object of the invention is to provide such a system that reduces maintainance problems, requires little diver intervention, requires little template mounted equipment, utilizes normally trained operators, and uses standard drilling technology and techniques.

Another object of the invention is to provide a jacking assembly that can jack the template up or down with infinite variation and can then be retrieved to the surface.

The foregoing objects are basically attained by providing a template levelling system for levelling a template on a plurality of suspension joints implanted in the floor of a body of water, the combination comprising a plurality of passageways formed in the template, each of the suspension joints passing through one of the passageways and extending above the template; a pair of guideposts pivotally coupled to the template adjacent each of the passageways; a handling string movable through the water; a hydraulic jack coupled to the handling string and including an inner member slidably received in an outer member; an articulated tension beam pivotally coupled to the inner member; a pair of tension joints; a mechanism for pivotally and releasably coupling the tension joints to the articulated tension beam; a mechanism for coupling the pair of tension joints to a pair of the guideposts; a support beam coupled to the suspension joints and releasably coupled to the outer member; and a mechanism on the support beam for releasably coupling the tension joints to the support beam.

The support beam has a centrally located blind cavity for the reception of the top of the suspension joint and also has a concentric but smaller central bore for receiving the outer member of the hydraulic jack, which also is received in the suspension joint.

The foregoing objects are also obtained by the method of installing a template adjacent the floor of a body of water, comprising the steps of lowering the template on the floor of the body of water, lowering a plurality of suspension joints through the water, passing the suspension joints through passageways in the template, and implanting the suspension joints in the floor of the body of water with portions thereof extending above the template, lowering a jacking assembly through the water and coupling the jacking assembly to a suspension joint and to the template, and actuating the jacking assembly to move the template relative to the suspension joint.

Other objects, advantages and salient features of the present invention will become apparent from the following detailed description, which, taken in conjunction with the annexed drawings, discloses an advantageous embodiment of the invention.

DRAWINGS

Referring now to the drawings which form a part of this original disclosure:

Figure 12:
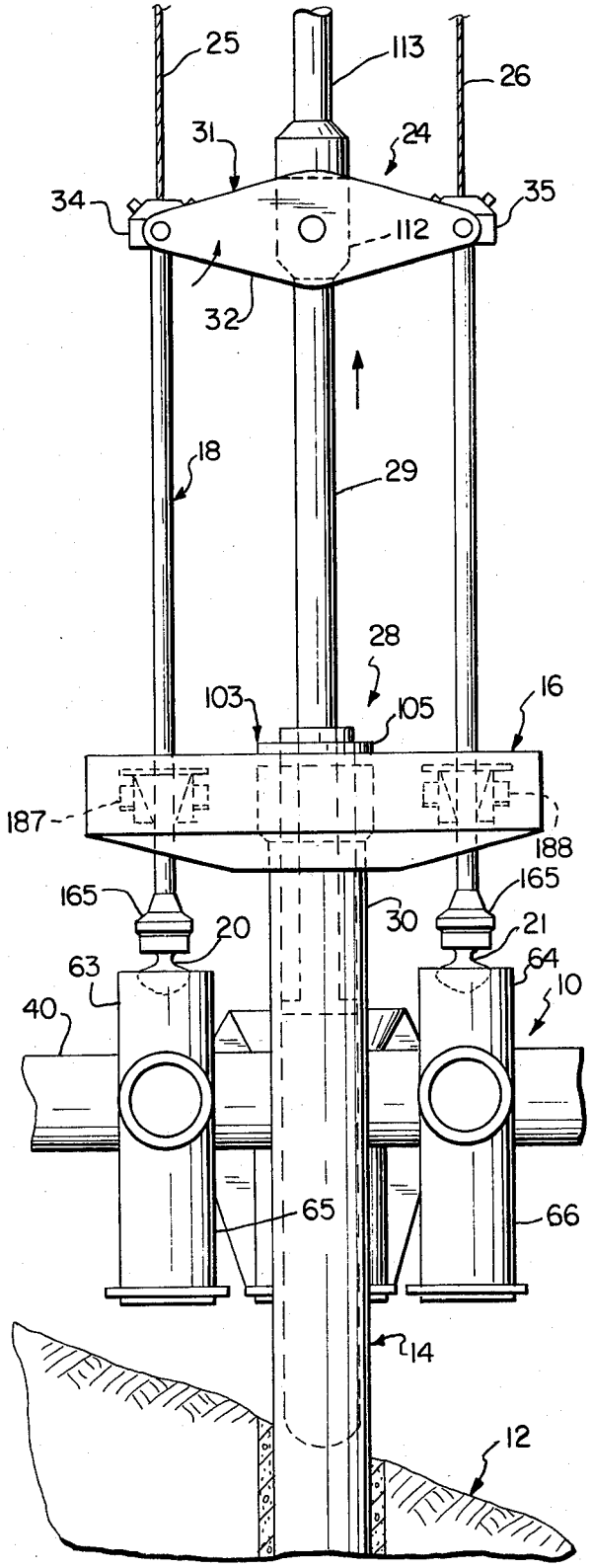
FIG. 12 is a side elevational view in section similar to that shown in FIG. 11 except that the inner member of the hydraulic jack has been moved upwardly, thereby pivoting the tension beam and thereby upwardly moving the second tension joint and thus pivoting the template upwardly into a level position.
Figure 13:
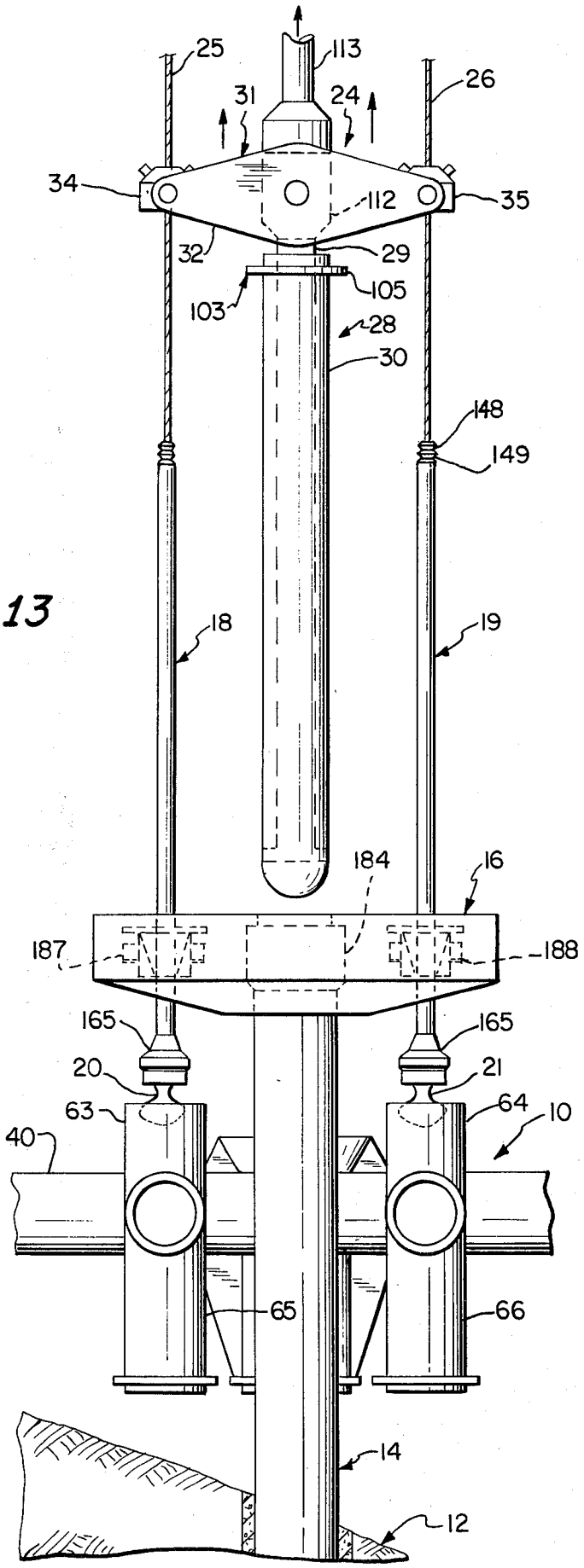
Figure 14:
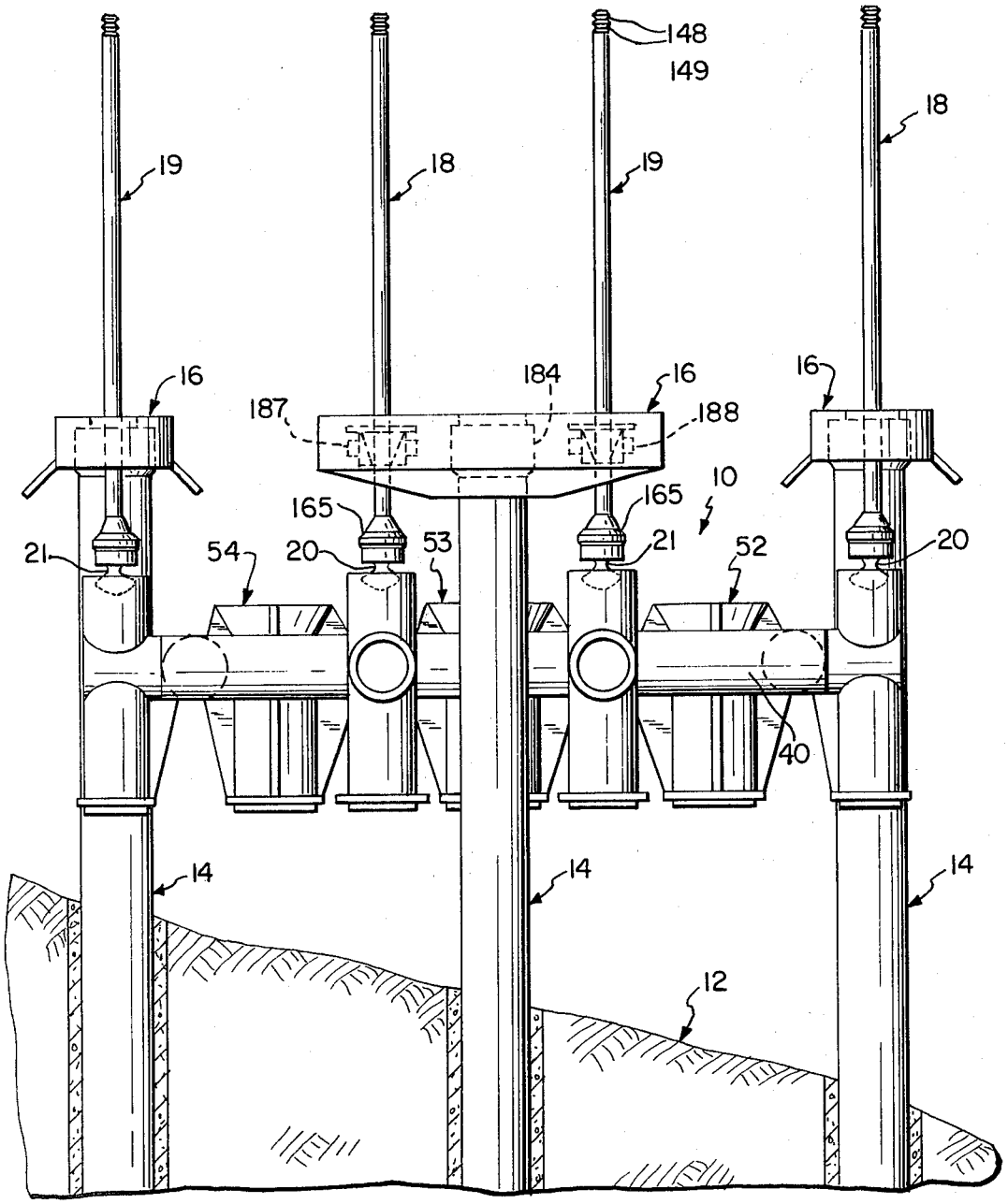

FIG. 13 is a side elevational view in section similar to that shown in FIG. 12 except that the tension joint connectors have been actuated to release the tension joints from the articulated tension beam, the outer member of the hydraulic jack has been upwardly moved, and the handling string has been moved upwardly, thereby carrying with it the hydraulic jack and the articulated tension beam; and FIG. 14 is a side elevational view of a levelled template showing the supporting action of the support beam, the two tension joints and the suspension joints, the guidelines having been severed.

DETAILED DESCRIPTION OF THE INVENTION

Referring now to FIGS. 1, 2, 5 and 14, the main purpose of the invention is to level the template 10 adjacent the inclined and irregular contour of the floor 12 of a body of water. As seen in FIG. 14, the template 10 is in the desired levelled position, and is supported on a plurality of suspension joints 14 implanted in the floor 12 of the body of water. In this levelled position shown in FIG. 14, each suspension joint is rigidly received in a support beam 16 which rigidly receives a pair of tension joints 18 and 19. Each of these joints is in turn rigidly coupled to one of guideposts 20 and 21 which are in turn pivotally coupled to the template on opposite sides of the suspension joint.

Figure 5:
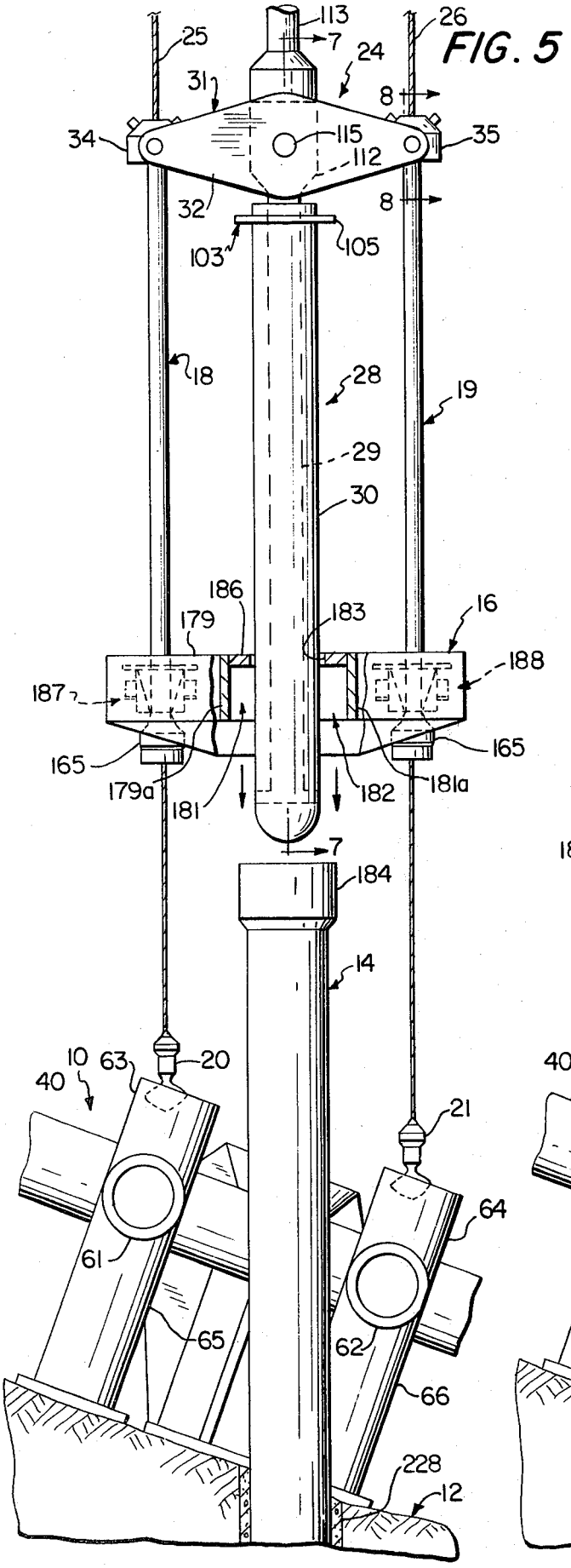
FIG. 5 is a side elevational view in section similar to that shown in FIG. 4 except that the suspension joint is fully implanted and the jacking assembly is being lowered down the guidelines towards the template and the suspension joint.

This levelling is accomplished by means of a jacking assembly 24, seen in FIG. 5, which is lowered down guidelines 25 and 26 coupled respectively to guideposts 20 and 21 on the template. Either one of these jacking assemblies will be utilized for each of the plurality of suspension joints used with the template, comprising a minimum of three such joints, or one such jacking assembly will be utilized for all of the suspension joints, with separate tension joints and support beams being associated with each suspension joint.

As seen in FIG. 5, the jacking assembly 24 comprises a hydraulic jack 28 including an inner member 29 and an outer member 30, an articulated tension beam 31 including a pair of beams 32 and 33 and a pair of tension joint connectors 34 and 35.

The Template

Figure 1:
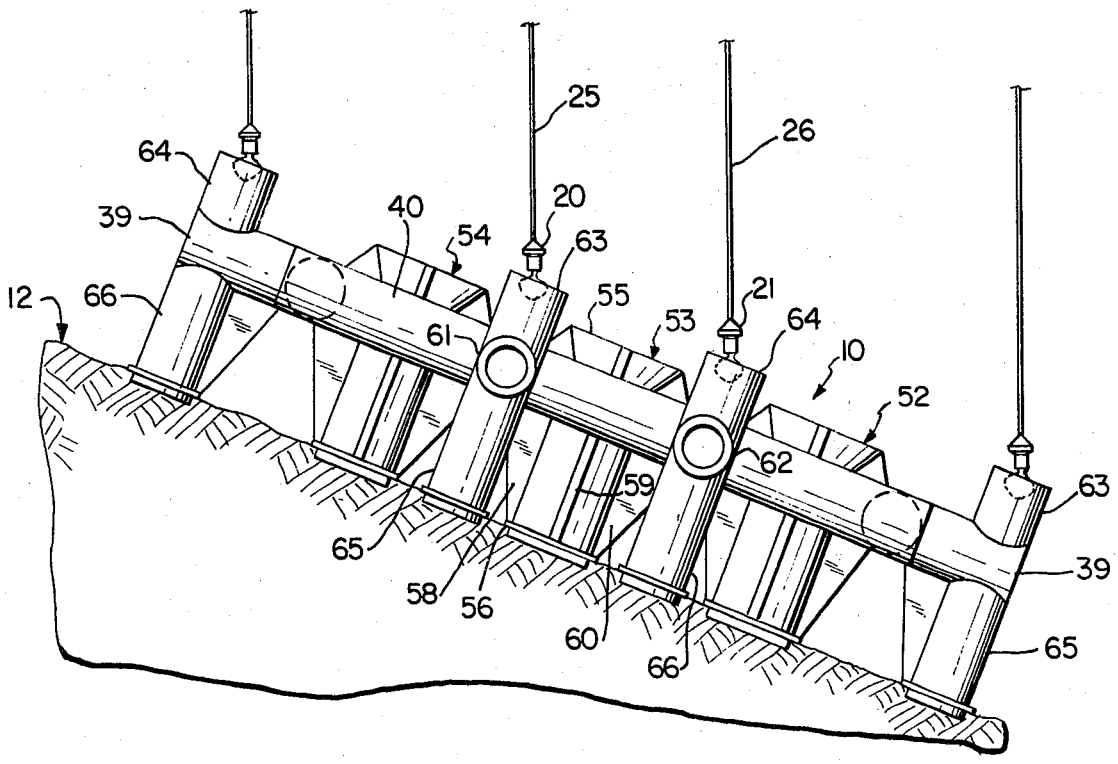
FIG. 1 is a side elevational view of a template landed on the inclined floor of a body of water with the use of guidelines extending from a vessel or platform on the surface of the water.
Figure 2:
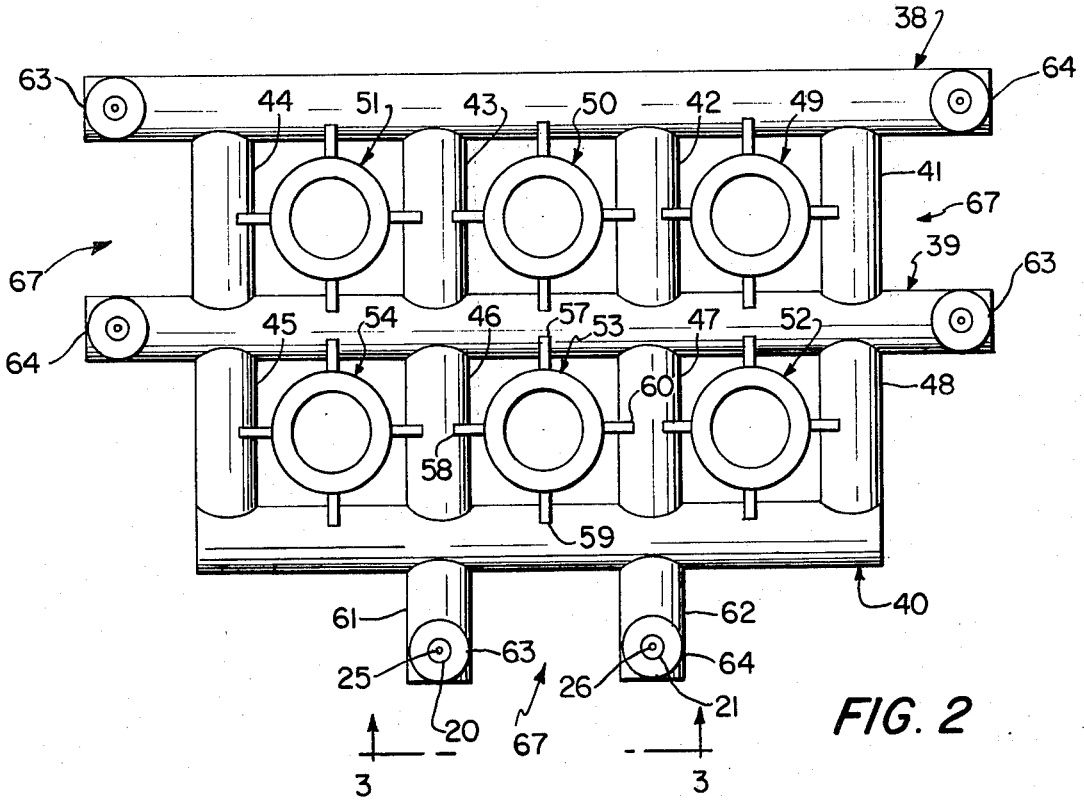
FIG. 2 is a top plan view of the template.

Referring now to FIGS. 1 and 2, the template 10 is shown as comprising a planar array of tubes or pipes interconnected in a lattice with slots therein with guide sleeves in the slots. The pipes are horizontal while the guide sleeves are vertical. Thus, as seen in FIGS. 1 and 2, the template includes three spaced, parallel longitudinal pipes 38, 39 and 40 and eight shorter pipes 41–48 extending transversely with pipes 41–44 being between pipes 38 and 39, and pipes 45–48 being between pipes 39 and 40. Pipes 41–44 are parallel and define with pipes 38 and 39 three square slots, each slot having a guide sleeve rigidly received therein including sleeves 49–51. Similarly, pipes 45–48 are parallel and define with pipes 39 and 40 three square slots, each slot having a guide sleeve rigidly received therein including sleeves 52–54. Each guide sleeve comprises a central tube with a frustoconical, outwardly tapered top 55 and an annular ring 56 spaced slightly above the bottom. Each guide sleeve is rigidly coupled to the floor adjacent pipes forming the slot by means of four webs 57–60.

Extending outwardly from pipe 40 and aligned with pipes 46 and 47 are two short horizontal pipes 61 and 62 which have a pair of vertical short pipes 63 and 64 extending upwardly respectively therefrom and a pair of vertical short pipes 65 and 66 extending downwardly respectively therefrom with annular rings adjacent the bottoms thereof.

The opposed ends of pipes 38 and 39 extend past pipes 41 and 48 on the right as seen in FIG. 2 and extend past pipes 44 and 45 on the left. At the left ends of pipes 38 and 39 are vertically oriented short pipes 63 and 65 extending respectively upwardly and downwardly on pipe 38 and short pipes 64 and 66 extending respectively upwardly and downwardly on pipe 39. Similar pipes 63–66 extend from pipes 38 and 39 at the right ends thereof.

It is in the passageway 67 formed between these pipes 63 and 64 that the suspension joints will be implanted into the floor of the body of water to level and support the template. On each of these short pipes 63 and 64 a guidepost is mounted having a guideline extending upwardly therefrom.

Figure 9:
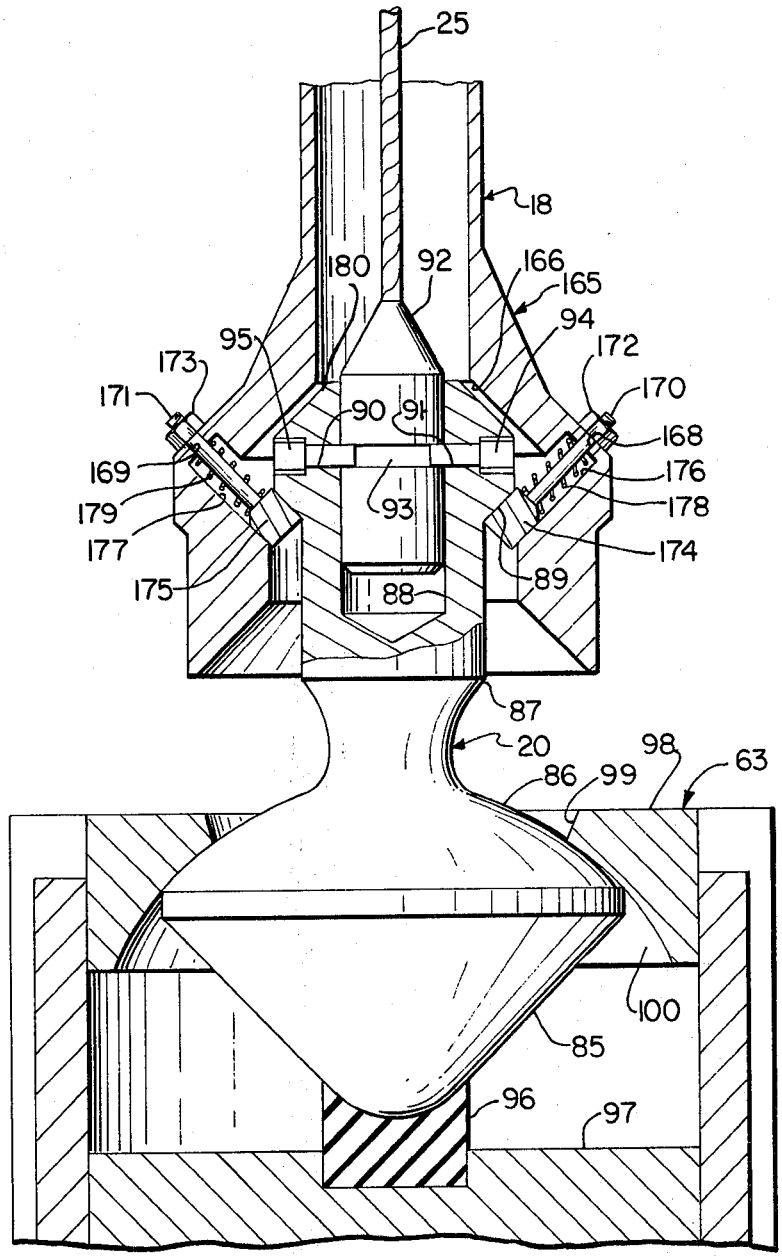
FIG. 9 is a longitudinal sectional view of a guidepost pivotally coupled to the template and coupled to a hub at the bottom of a tension joint.

Referring now to FIG. 9, the details of the guidepost 20 pivotally coupled to short pipe 63 in the template is shown. This guidepost comprises a downwardly and inwardly tapered frustoconical base 85, an upper portion 86 extending from the base 85 in the form of part of a sphere and an extension 87 extending upwardly from the upper portion 86. This extension has a central cylindrical blind bore 88 at its top, a downwardly and inwardly tapered frustoconical shoulder 89 on the exterior surface and a pair of horizontally oriented bores 90 and 91 extending from the outer surface thereof completely through into the cylindrical central bore 88. As seen in FIG. 9, a bushing 92 rigidly connected to the lower end of guideline 25 has an extenal annular groove 93 for the reception of pins 94 and 95 which extend through bores 90 and 91 in extension 87 and engage groove 93 when the bushing 92 is in the central bore 88.

The bottom of base 85 of the guidepost 20 is supported on a rubber block 96 which is in turn supported on a plate 97 rigidly secured to the inside of the pipe 63.

In engagement with the upper portion 86 of the guidepost is a restraining member 98 rigidly connected to the pipe 63 and having a central bore 99 for the reception of a part of upper portion 86 and extension 87 and also has a surface 100 which is downwardly facing and is part of a sphere to allow the upper portion to pivot relative thereto. Thus, the guidepost 20 is pivotally coupled to the pipe 63.

The Jacking Assembly

Figure 7:
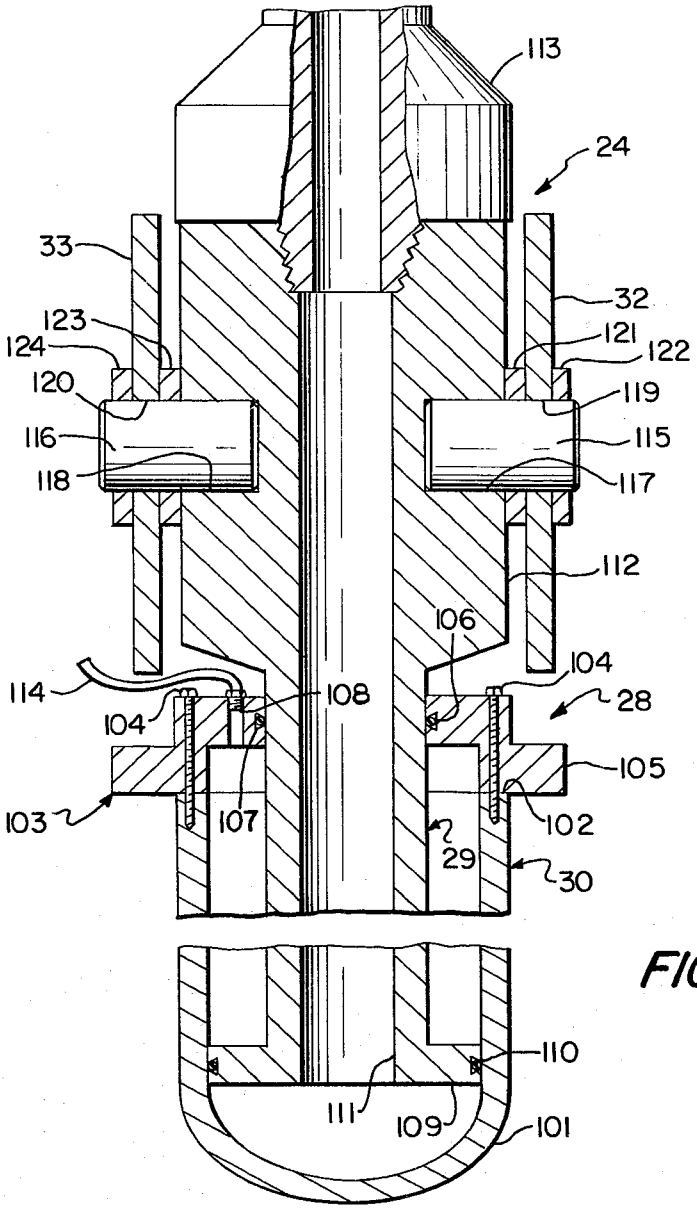
FIG. 7 is an enlarged longitudinal sectional view taken along lines 7—7 in FIG. 5 showing the interior of the hydraulic jack and the configuration of the articulated tension beam.

The hydraulic jack 28 included as part of the jacking assembly 24 is shown in detail in FIG. 7 with the inner member 29 slidably received in the outer member 30. The inner member acts as a hydraulic piston and rod while the outer member acts as a hydraulic cylinder. Advantageously, the jack can exert 3500 psi with a working area of about 452 square inches. The outer member 30 is hollow and cylindrical with a curved closed bottom end 100 and an open top end 102. The outer diameter of outer member 30 is advantageously 24 inches. A flange 103 is bolted via bolts 104 to the top of the outer member, this flange having an outer annular portion 105 extending outward from the outer diameter of outer member 30 and an inner annular portion 106 extending inwardly of the outer member 30 into a slidable and sealing engagement with the outer diameter of the inner member 29. A sealing ring 107 is received in a suitable groove in the inner portion 106 in contact with the outer diameter of the inner member 29.

At the very bottom of the inner member 29 is an annular outwardly extending flange 109 having a sealing ring 110 received in a suitable groove therein and in slidable and sealing engagement with the inner diameter of the inner member 30.

The inner member 29 has a central bore 111 extending completely through its longitudinal length through which hydraulic fluid under pressure can be introduced from the surface to move the outer member downwardly relative to the inner member. To reverse this motion a bore 107 is formed in flange 103 suitably receiving a hydraulic line 114.

At the top of the inner member 29 is an enlarged diameter portion 112 and above that the inner member is releasably coupled to a handling string 113 which is vertically movable through the water to lower or raise the jacking assembly. The connection between the inner member and the handling string is via a conventional threaded coupling.

Referring to FIGS. 5 and 7, the inner member 29 of the hydraulic jack is pivotally coupled to plates 32 and 33 of the articulated tension beam 31 by means of a pair of pins 115 and 116. These pins are received in opposed blind bores 117 and 118 in the enlarged diameter portion 112 of the inner member and also in bores 119 and 120 formed respectively in the center of plates 32 and 33. As seen in FIG. 7, bushings 121 and 122 are located adjacent the opposite sides of plate 32 and receive pin 115 therein. Similar bushings 123 and 124 are used in conjunction with plate 33 and pin 116. If necessary, additional structural members can be used to connect plates 32 and 33.

Figure 8:
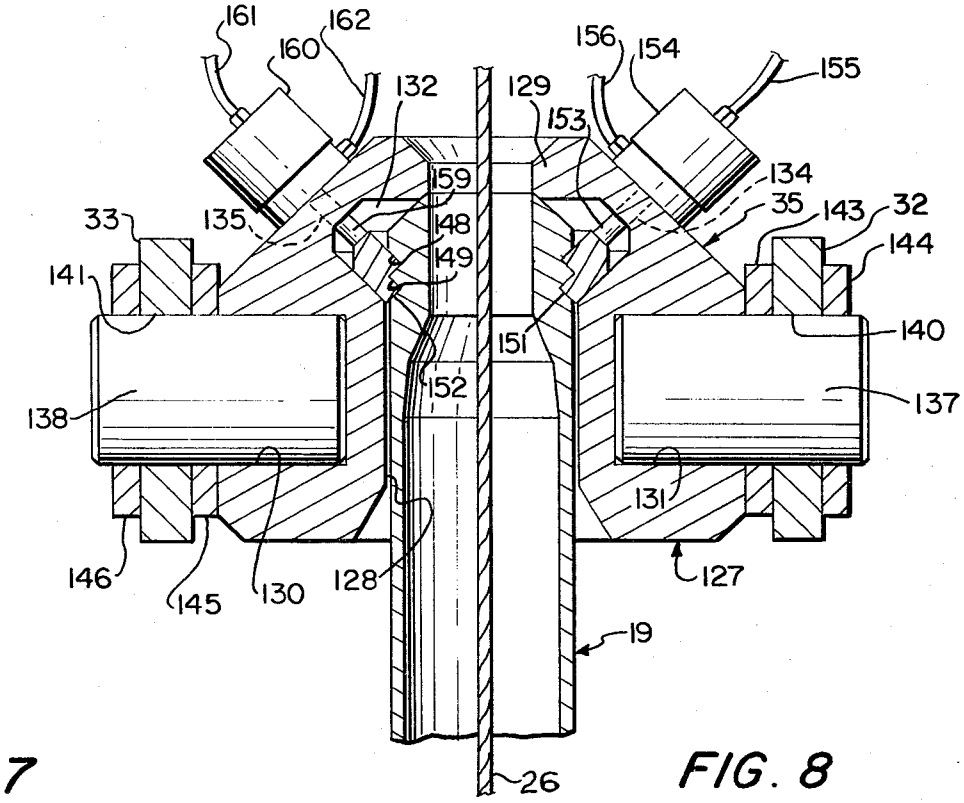
FIG. 8 is a side elevational view in section taken along lines 8—8 in FIG. 5 showing the interior of the tension joint connector on the articulated tension beam and the interior of a tension joint.

At the opposite ends of the two plates 32 and 33 forming the tension beam 31 are the tension joint connectors 34 and 35. The details of connectors 35 are shown in FIG. 8 which are the same as that for connector 34. In particular, connector 35 comprises a main body portion 127 with a vertical bore 128 formed completely therethrough with an annular shoulder restriction 129 at the top thereof. The body portion 127 also has two opposed horizontal blind bores 130 and 131 and has a substantially annular cavity 132 below the restriction 129 with bores 134 and 135 extending through the body portion from the exterior surface into communication with cavity 132.

Received in blind bores 130 and 131 are a pair of pins 137 and 138, which pins are also received respectively in bores 140 and 141 in plates 32 and 33 forming the articulated tension beam 31. Bushings 143 and 144 are carried by pin 137 on opposite sides of the plate 32. Similarly, bushings 145 and 146 are carried by pin 138 on opposite sides of plate 33. This pivotally couples the tension joint connector 35 to plates 32 and 33.

As seen in FIG. 8, tension joint 19 has a pair of annular grooves 148 and 149 on the exterior surface with a triangular cross-section near the distal end. After insertion of the tension joint 19 into vertical bore 128, continued movement upward would be stopped by restriction 129. A pair of latching dogs 151 and 152 located in cavity 132 engage these grooves 148 and 149 by having an outer configuration corresponding to these grooves, thereby releasably securing the tension joint to the tension joint connector. These latching dogs are movable towards and away from the tension joint by means of hydraulic action. Thus, latching dog 151 is rigidly connected to a shaft 153 which extends through bore 134 and into a hydraulic cylinder 154. Hydraulic lines 155 and 156 coupled to a supply of hydraulic fluid under pressure at the surface are suitably connected to the hydraulic cylinder 154 to actuate shaft 153. The other latching dog 152 has a similar shaft 159 rigidly coupled thereto which passes through bore 134 into a second hydraulic cylinder 160 which has a pair of hydraulic lines 161 and 162. Alternately, dogs 151 and 152 can be spring biased into the latching position.

As seen in FIG. 8, the guideline 26 passes concentrically through the center of the hollow tension joint 19 as well as through connector 35 via bore 128. Tension joints 18 and 19 advantageously have an outer diameter of seven inches.

Referring now to FIG. 9, the bottom of the tension joint 18 is shown in detail, this being the same for tension joint 19. As seen therein, the joint has an enlarged hub 165 therein which is hollow for the reception of extension 87 on the top of guidepost 20. The inside of the hollow hub has a frustoconical surface 166 corresponding to a frustoconical surface 180 on the very top of extension 87. The hub also has a pair of bores 168 and 169 extending therethrough receiving threaded rods 170 and 171 respectively. Each rod has a nut 172 and 173 respectively at the distal end on the outside of the hub and has a locking dog 174 and 175 respectively at the distal end on the inside of the hub. Concentric with bores 168 and 169 are larger bores 176 and 177 through which rods 170 and 171 extend respectively with locking dogs 174 and 175 being slidably movable therealong. Interposed in these bores 176 and 177 between the hub and the locking dogs are a pair of compression springs 178 and 179 which bias the locking dogs radially inward of the hub. Thus, downward movement of the tension joint 18 over extension 87 will cause the frustoconical surface 180 at the very top of the extension to bias the locking dogs 174 and 175 outward, allowing the hub to be lowered over the extension and then to spring back into an engaging relationship with shoulder 89 on extension 87.

Figure 6:
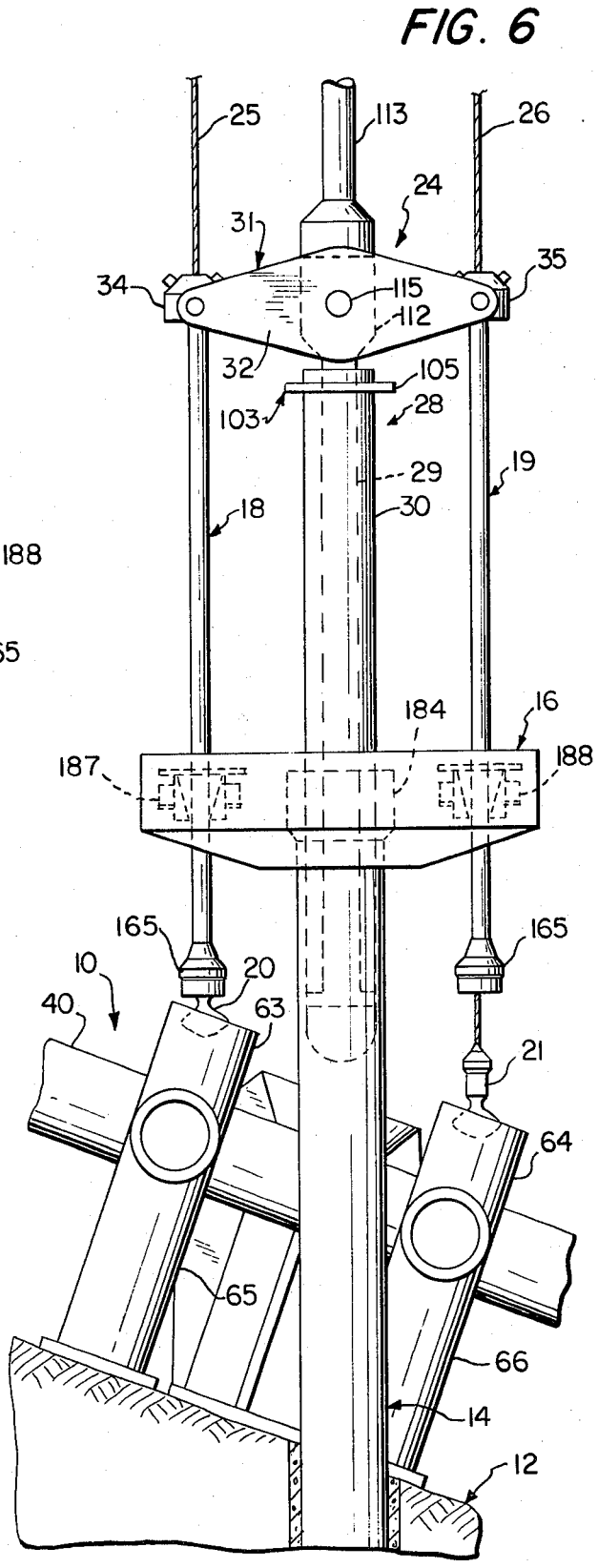
FIG. 6 is a side elevational view in section similar to that shown in FIG. 5 except that the support beam has been landed on the suspension joint, the outer member of the hydraulic jack has been received in the suspension joint and one of the tension joints has been coupled to one of the guideposts on the template.

Referring now to FIG. 5, the support beam 16 is shown comprised of two parallel plates 179 and 181 with two transverse parallel plates 179*a* and 181*a* rigidly coupled therebetween and covered by a central plate 186 having a central aperture 183. Concentric with this aperture 183 and extending below plate 186 is a blind cavity 182 formed by plates 179, 181, 179*a* and 181*a*. The cavity 182 is slightly larger than the outer diameter of a hub 184 on the top of suspension joint 14 and receives this hub therein. Aperture 183 is slightly larger than the outer diameter of the outer member 30 in the hydraulic jack 28, but smaller than the outer diameter of hub 184. In addition, as indicated in FIG. 6 the inner diameter of suspension joint 14 is slightly larger than the outer diameter of the outer member 30 so member 30 can slide into the suspension joint 14. When the support beam 16 is lowered over hub 184, as seen in FIG. 6, the support beam slidably receives the hub 184 and is thus rigidly attached to the suspension joint 14, further downward movement of beam 16 relative to joint 14 being prevented by contact of the top of the hub 184 with plate 186 on the beam 16 which is shown in FIG. 5.

Figure 10:
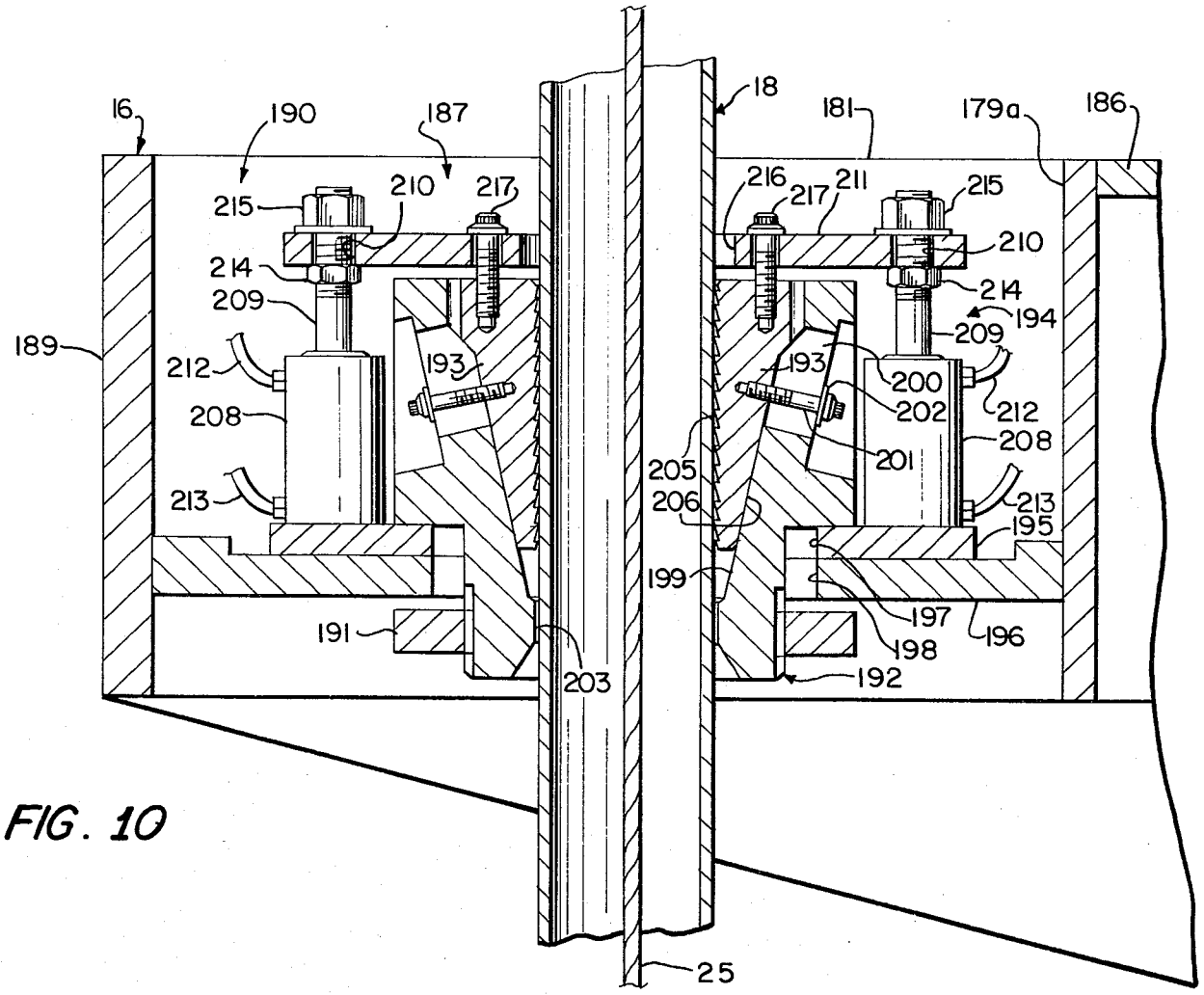
FIG. 10 is a longitudinal fragmentary sectional view through the support beam showing a hydraulic slips assembly for releasably gripping a tension joint.

As also seen in FIGS. 5 and 10, the support beam 16 carries a pair of hydraulic slips assemblies 187 and 188 to releasably couple the tension joints 18 and 19 to the support beam. These assemblies are the same and therefore only one will be described in detail with reference to FIG. 10. Thus, the beam 16 has a cavity 190 formed in the top thereof and located in cavity 190 is the hydraulic slips assembly 187 comprised of a support member 192, a plurality of gripping members 193 and a hydraulic power device 194 for moving the gripping members 193 relative to the support member 192.

The support member 192 is rigidly secured to a support plate 195 which is in turn slidably supported on a base plate 196 rigidly connected to plates 179, 181 and 179*a* in beam 16 and to end plate 189 thereof. Each of the plates 195 and 196 has a central aperture 197 and 198 respectively for receiving the support member therein. This support member has an internal frustoconical surface or bowl 199 which is downwardly and inwardly tapered and has a plurality of slots 200 extending vertically therethrough for the reception of a plurality of bolts 201 having enlarged washers 202 spanning each slot. These bolts are also received in the gripping members.

A central bore 203 is formed in the support member 192 for the reception of the tension joint 18. The bottom of member 192 below plate 196 is threaded to loosely receive nut 191 thereon.

Each of the gripping members 193 has an inner surface 205 which is arcuate and serrated for engagement with the outer diameter of the tension joint and has an outer surface 206 which is downwardly and inwardly tapered in a frustoconical configuration to correspond to the frustoconical surface 199 of the support member. Thus, the gripping members 193 are vertically slidable relative to the support member, these gripping members being in an unlocked position when they are moved upwardly and therefore away from the longitudinal axis of the tension joint and into a locking or gripping position when they are moved downwardly and inwardly of the longitudinal axis of the tension joint 18. Each gripping member is in the form of a segment of a circle.

This movement is accomplished by the power device 194 which comprises a plurality of hydraulic cylinders 208 rigidly mounted on plate 195 and having piston rods or shafts 209 extending upwardly therefrom and being received in apertures 210 in a connecting plate 211 located above the gripping members 193. Hydraulic fluid under pressure is supplied from the surface of the body of water to each of the cylinders 208 via hydraulic lines 212 and 213. Each shaft 209 is rigidly secured to the connecting plate 211 by means of a lower nut 214 and an upper nut 215 on opposite sides of plate 211. This plate has a central aperture 216 to allow the tension joint 18 to pass therethrough. Securing the gripping members 193 to the connecting plate 211 are a plurality of bolts 217 passing through suitable apertures in the connecting plate into suitably internally threaded blind bores in the tops of gripping members 193. Hydraulic lines 212 and 213 are advantageously coupled to a manifold on the beam which is in turn connected to hydraulic lines leading to the surface by a remotely disconnecting device. Once the template is levelled, these lines are disconnected from the surface.

The Levelling Operation

The first step in levelling the template 10 is to lower the template via guidelines from a vessel or platform at the surface of the body of water downwardly through the water and landing the template on the floor of the body of water 12, as seen in FIG. 1.

Figure 4:
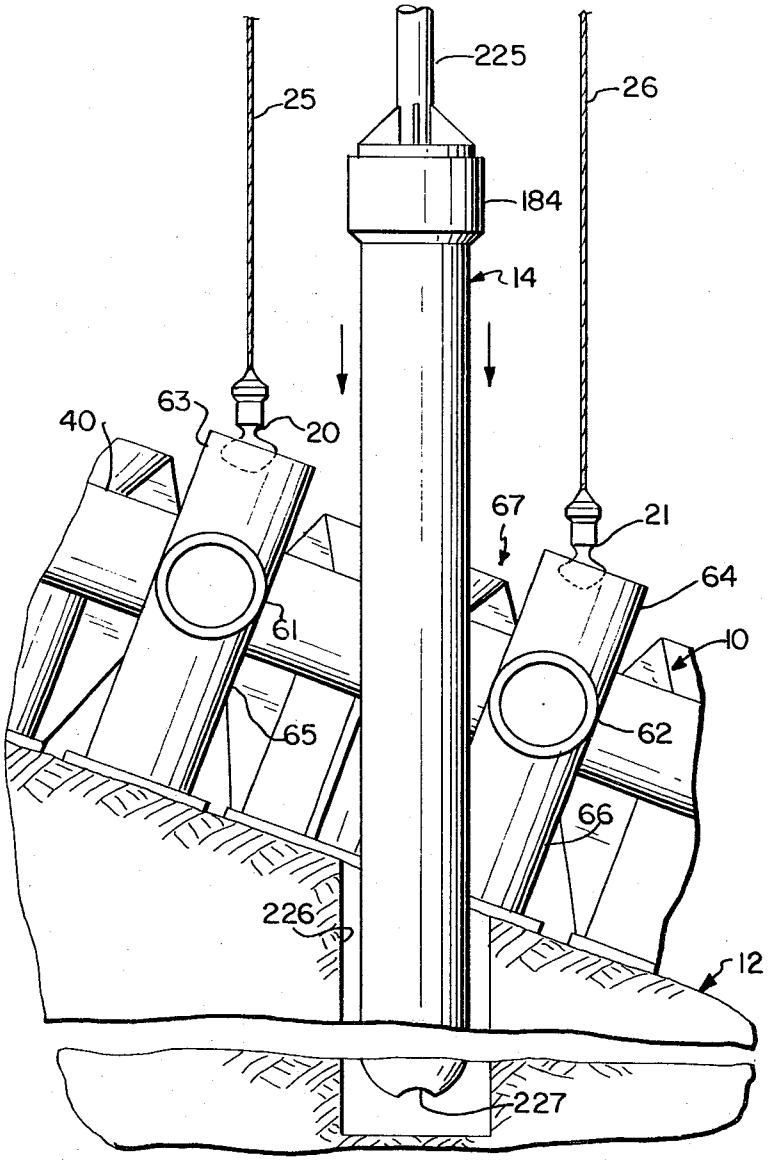
FIG. 4 is a side elevational view in section similar to that shown in FIG. 3 except that the suspension joint is being implanted into the bore formed in the floor of the body of water.
Figure 3:
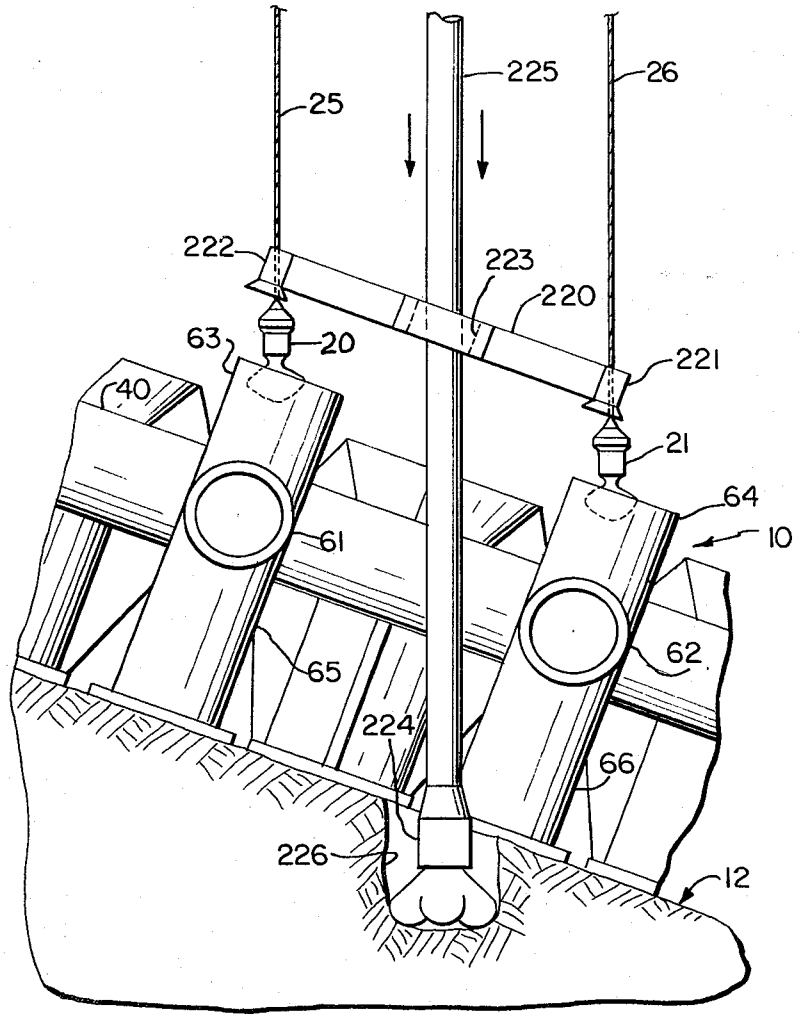
FIG. 3 is a side elevational view in section taken along lines 3—3 in FIG. 2 but also showing a drill bit drilling into the floor of the body of water.

The next step includes lowering a drill bit guide 220, seen in FIG. 3, down the guidelines, this guide having a pair of sleeves 221 and 222 at its opposite ends for slidably receiving the guidelines and a central aperture 223 for receiving a drill bit 224 at the end of a length of drill string 225. Once the drill bit guide 209 is in place at the bottom of the guidelines resting on the guideposts 20 and 21 as shown in FIG. 3, with the drill string 225 located in the central aperture 223, the drill bit 224 is placed against the floor 12 of the body of water and drilling commences as shown in FIG. 3. This drilling forms a bore 226 in and through the floor 12. Once the correct depth of the bore 226 is obtained, the drill bit, drill bit guide, and drill string are returned to the surface of the body of water. Then the drill string 225 is fitted at the bottom with a suitable tool for connecting to the hub 184 of the suspension joint 14 as seen in FIG. 4. Advantageously, the suspension joint is 30 inches in diameter and has an opening 227 at the bottom to allow cement to flow therethrough. If great length is necessary, the joint 14 can be connected to additional piles. The drill string 224 is thus again lowered down to the floor 12 maneuvering the suspension joint 14 through passageway 67 and between pipes 61 and 62 in the template and then into the bore 226 in the floor. Cement is then run down through the drill string 225 through hub 184 into the hollow suspension joint 14 and then out via opening 227. This cement 228 or grout is then pumped continuously so as to substantially fill the bore 226 and support the joint 14 through passageway 67 and in a substantially vertical position as seen in FIGS. 4 and 5. Before the cement is run in, television monitors located on the guideposts or guidelines can be used to determine the vertical position of the suspension joint.

After the suspension joint 14 is secured in the floor, the jacking assembly 24 is lowered down the guidelines 25 and 26 as shown in FIG. 5. This lowering is accomplished with the guidelines running concentrically through the tension joints 18 and 19 which joints are connected at the top to the tension joint connectors 34 and 35 and connected at the bottom to the support beam 16 with the outer member 30 of the hydraulic jack 28 being received in cavity 182 and aperture 183 in support beam 16. During this movement, activation of the hydraulic slips 187 and 188 is not necessary since the bottom of beam 16 is supported on the hubs 165 at the bottom of the tension joints.

The jacking assembly 24 is continued to be lowered along the guidelines until the outer member 30 of the hydraulic jack is received in the suspension joint 14, the top of hub 184 on joint 14 is received on the bottom of plate 186 in beam 16, and the hub 165 on tension joint 18 is rigidly received on guidepost 20. This is shown in FIG. 6.

Figure 11:
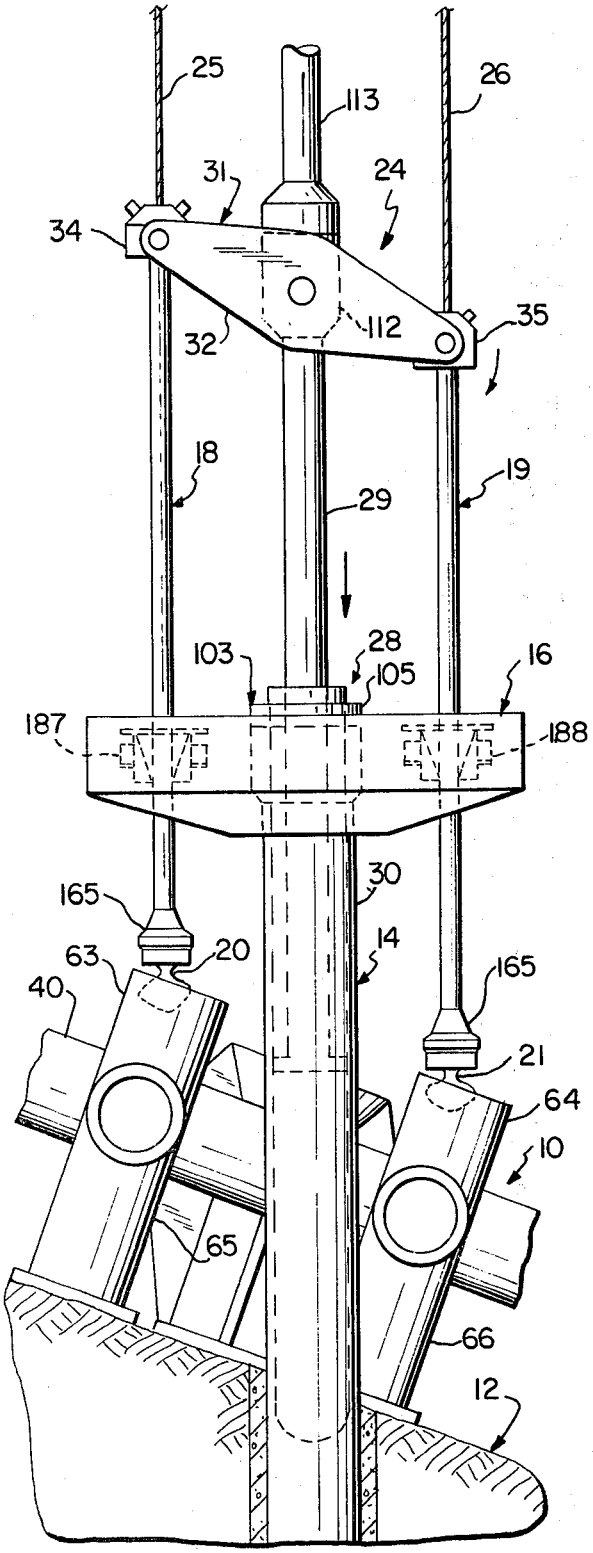
FIG. 11 is a side elevational view in section similar to that shown in FIG. 6 except that the outer member of the hydraulic jack has been extended fully into the suspension joint, the inner member has been moved downwardly relatively to the outer member and the second tension joint has thus been pivoted downwardly into engagement with the second guidepost on the template.

Next, the outer member 30 of the hydraulic jack is extended fully downwardly until the outer portion 105 of flange 103 thereon is firmly landed on the top of the support beam 16 as shown in FIG. 11. After this is completed, the inner member 29 is caused to move downwardly into the outer member 30, thereby pivoting the articulated tension beam 31 relative to tension joint connector 34 which is rigidly connected via tension joint 18 to the template 10. This downward movement of inner member 29 and resulting pivoting of beam 31 results in a longitudinal downward movement of tension joint 19 as it pivots via tension joint connector 35 relative to beam 31. This downward movement of tension joint 19 can be accomplished after hydraulic cylinders 208 in hydraulic slips assembly 188 are activated to move the gripping members 193 into an unlocking position. The downward movement of tension joint 19 is continued until hub 165 thereon is rigidly connected to guidepost 21, as shown in FIG. 11.

As seen in FIG. 12, the next step comprises an upward extension of inner member 29 relative to outer member 30 of the hydraulic jack which moves the template upwardly into a levelled position. Thus, upward movement of member 29 causes beam 31 to pivot upwardly relatively to tension joint connector 34 and thereby carry tension joint 19 and the template connected thereto upwardly.

Then, the hydraulic slips assembly 188 is activated to move the gripping members 193 downwardly into a locking position. This firmly locks tension joint 19 to beam 16.

To completely level the remainder of the template, a plurality of additional jacking assemblies 24 can be utilized for each of the suspension joints with corresponding additional tension joints and support beams. Alternatively, one jacking assembly can be used for each of the suspension joints with the added necessary support beams and tension joints.

In all events, once levelling is fully complete, the jacking assembly 24 is removed from the template. This is shown in FIG. 13 where jacking assembly 24 is moving upwardly via handling string 113 and guided by the guidelines 25 and 26. This is accomplished by activating hydraulic cylinders 154 and 160 in each of the tension joint connectors 34 and 35 to release these connectors from the grooves 148 and 149 at the top of each of the joints. This is also accomplished by merely sliding the outer member 30 of the hydraulic jack out of the support beam 16 and suspension joint 14. Before the entire assembly is raised, the outer member 30 can be moved upwardly relatively to the inner member 29 as seen in FIG. 13. Once the jacking assembly is removed, the guidelines can be severed in a conventional manner above each tension joint.

The remaining levelled template is shown in FIG. 14 where the template 10 is supported by a plurality of suspension joints, with three joints 14 being shown. At a minimum, three suspension joints should be used; however, four or more suspension joints can be utilized.

While an advantageous embodiment has been chosen to illustrate the invention, it will be understood by those skilled in the art that various changes and modifications can be made therein without departing from the scope of the invention as defined in the appended claims.

What is claimed is:

1. A template levelling system for levelling a template on a plurality of suspension joints implanted in the floor of a body of water, the combination comprising:

a plurality of passageways formed in the template, each of the suspension joints passing through one of said passageways and extending above the template;

a pair of guideposts pivotally coupled to the template adjacent each of said passageways;

a handling string movable through the water;

a hydraulic jack coupled to said handling string and including an inner member slidably received in an outer member;

an articulated tension beam pivotally coupled to said inner member;

a pair of tension joints;

means for pivotally and releasably coupling said tension joints to said articulated tension beam;

means for coupling said pair of tension joints to a pair of said guideposts;

a support beam coupled to said suspension joint and releasably coupled to said outer member; and means, on said support beam, for releasably coupling said tension joints to said support beam.

2. A system according to claim 1, wherein said support beam has a blind cavity for receiving said suspension joint therein.

3. A system according to claim 1, wherein said suspension joint is hollow and receives said outer member therein.

4. A system according to claim 1, wherein said outer member has a flange thereon engaging said support beam.

5. A system according to claim 1, wherein said means for pivotally and releasably coupling said tension joints to said articulated tension beam comprises a pair of connector members, means for pivotally coupling each connector member to said tension beam, and means for releasably coupling each of said tension joints to one of said connector members.

6. A system according to claim 5, wherein said means for releasably coupling each of said tension joints to one of said connector members comprises at least one annular groove formed in said tension joint, and a plurality of latching dogs engagable with said groove and coupled to said connector member.

7. A system according to claim 1, wherein said means for coupling said pair of tension joints to a pair of said guideposts comprises an annular groove formed in each of said guideposts, and a plurality of spring biased locking dogs coupled to said tension joints and engagable with said groove.

8. A system according to claim 1, wherein said means for releasably coupling said tension joints to said support beam comprises a support member having an inner frustoconical surface and coupled to said support beam, a plurality of gripping members having outer frustoconical surfaces slidably received by said inner surface of said support member and having serrated inner surfaces engagable with said tension joints, and power means for moving said gripping members relative to said support member.

9. A levelled template comprising:

a plurality of suspension joints implanted in the floor of a body of water;

a rigid, generally planar template;

a plurality of passageways formed in said template, each of said suspension joints passing through one of said passageways and extending above said template;

a plurality of support beams, each rigidly coupled to one of said suspension joints above said template;

a plurality of tension joints coupled to and extending upwardly from said template, each of said support beams having gripping means for releasably gripping a pair of said tension joints to couple them thereto; and means for moving said gripping means relative to said tension joints.

10. A levelled template according to claim 9, wherein each of said support beams has a bore therein receiving one of said suspension joints.

11. A levelled template according to claim 9, wherein each of said tension joints is pivotally coupled to said template.

12. A levelled template comprising:

a plurality of suspension joints implanted in the floor of a body of water;

a rigid, generally planar template;

a plurality of passageways formed in said template, each of said suspension joints passing through one of said passageways and extending above said template;

a plurality of support beams, each rigidly coupled to one of said suspension joints above said template; and a plurality of tension joints coupled to and extending upwardly from said template, each of said support beams having means for rigidly coupling a pair of said tension joints thereto, wherein said means for rigidly coupling a pair of said tension joints comprises:

a support member having an inner frustoconical surface and coupled to said support beam, a plurality of gripping members having outer frustoconical surfaces slidably received by said inner surface of said support member and having serrated inner surfaces engageable with said tension joints, and power means for moving said gripping members relative to said support member.

13. A method of installing a template adjacent the floor of a body of water, comprising the steps of lowering the template through the body of water and landing the template on the floor of the body of water, the template having a plurality of passageways with a pair of guideposts pivotally coupled to the template on opposite sides of each passageway, lowering a plurality of suspension joints through the water, passing the suspension joints through the passageways in the template, and implanting the suspension joints in the floor of the body of water with portions thereof extending above the template, lowering a jacking assembly through the water and remotely coupling the jacking assembly to a suspension joint and to a pair of the guideposts, and actuating the jacking assembly to move the template relative to the suspension joint.

14. A method according to claim 13, wherein the coupling step comprises:

landing a support beam on the suspension joint.

15. A method according to claim 13, wherein the coupling step comprises:

attaching a tension joint in the jacking assembly to one of the pair of guideposts on the template.

16. A method according to claim 15, wherein the coupling step further comprises:

attaching a second tension joint in the jacking assembly to a second of the pair of guideposts on the template.

17. A method according to claim 16, wherein the actuating step comprises:

moving the two tension joints vertically relative to one another.

18. A method of installing a template adjacent the floor of a body of water, comprising the steps of:

lowering the template through the body of water and landing the template on the floor of the body of water, lowering a plurality of suspension joints through the water, passing the suspension joints through passageways in the template, and implanting the suspension joints in the floor of the body of water with portions thereof extending above the template, lowering a jacking assembly through the water and coupling the jacking assembly to a suspension joint and to the template, and actuating the jacking assembly to move the template relative to the suspension joint, wherein the coupling step comprises:

attaching a first tension joint in the jacking assembly to a guidepost on the template and attaching a second tension joint in the jacking assembly to a second guidepost on the template, and wherein the actuating step comprises:

moving the two tension joints vertically relative to one another, and pivoting a tension beam that is pivotally coupled to each tension joint.

19. A method according to claim 18, and further comprising the step of releasing the tension beam from the tension joints and raising the tension beam through the water.

20. A jacking assembly for levelling a template adjacent the floor of a body of water, the combination comprising:

a handling string movable through the water;

a hydraulic jack coupled to said handling string and including an inner member slidably received in an outer member;

an articulated tension beam pivotally coupled to said inner member;

a pair of tension joints;

means for pivotally and releasably coupling said tension joints to said articulated tension beam;

means, on said tension joints, for coupling said tension joints to the template;

a support beam releasably coupled to said outer member; and means, on said support beam, for releasably coupling said tension joints to said support beam.

21. A jacking assembly according to claim 20, wherein said support beam has a bore therein for slidably receiving said outer member therein.

22. A method of installing a template adjacent the floor of a body of water, comprising the steps of lowering the template through the body of water and landing the template on the floor of the body of water, lowering a plurality of suspension joints through the water, passing the suspension joints through passageways in the template, and implanting the suspension joints in the floor of the body of water with portions thereof extending above the template, lowering a jacking assembly through the water, and remotely inserting a part of the jacking assembly into a suspension joint and remotely pivotally coupling a part of the jacking assembly to the template, and actuating the jacking assembly to pivot the template relative to the suspension joint to a substantially levelled position.

* * * * *